US012123692B2

(12) United States Patent
Jones et al.

(10) Patent No.: US 12,123,692 B2
(45) **Date of Patent: *Oct. 22, 2024**

(54) TABLE TOP PRIMING MACHINE FOR SMALL CALIBER AMMUNITION

(71) Applicant: BITTERROOT TOOL & MACHINE, LLC, Stevensville, MT (US)

(72) Inventors: Randy J. Jones, Stevensville, MT (US); Jeff C. Hritcu, Stevensville, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/233,603

(22) Filed: Aug. 14, 2023

(65) Prior Publication Data

US 2023/0392911 A1 Dec. 7, 2023

Related U.S. Application Data

(63) Continuation of application No. 17/149,328, filed on Jan. 14, 2021, now Pat. No. 11,768,064.

(60) Provisional application No. 62/961,287, filed on Jan. 15, 2020.

(51) Int. Cl.

| | |
|---|---|
| ***F42B 33/02*** | (2006.01) |
| ***F42B 33/00*** | (2006.01) |
| ***F42B 33/04*** | (2006.01) |

(52) U.S. Cl.

CPC ..... *F42B 33/04* (2013.01); *F42B 33/002* (2013.01); *F42B 33/004* (2013.01); *F42B 33/02* (2013.01)

(58) Field of Classification Search

CPC ..... F42B 33/00; F42B 33/001; F42B 33/002; F42B 33/004; F42B 33/02; F42B 33/04

USPC ..... 86/23, 27, 31, 32, 36

See application file for complete search history.

(56) References Cited

U.S. PATENT DOCUMENTS

| | | | | |
|---|---|---|---|---|
| 1,311,256 | A * | 7/1919 | Wilcox | F42B 33/002 86/45 |
| 5,198,606 | A * | 3/1993 | Storstad | F42B 33/04 86/32 |
| 7,552,668 | B1 * | 6/2009 | Gonzalez | F42B 33/001 86/45 |
| 8,683,906 | B2 * | 4/2014 | Baxter | F42B 33/004 86/31 |
| 8,820,206 | B2 * | 9/2014 | Coma Asensio | F42B 33/001 86/19.5 |
| 9,989,342 | B1 * | 6/2018 | Lougeay | F42B 33/002 |
| 10,443,994 | B2 * | 10/2019 | Gatti | F42B 33/002 |
| 11,768,064 | B2 * | 9/2023 | Jones | F42B 33/004 86/37 |

* cited by examiner

*Primary Examiner* — James S Bergin
(74) *Attorney, Agent, or Firm* — Mitchell J. W. Vap

(57) ABSTRACT

The herein described Table Top Priming Machine for Small Caliber Ammunition provides a simple, safe, and more precise means to produce reliable ammunition than other priming machines in the prior art. The Table Top Priming Machine uses a unique rotary disk assembly to hold cases as the machine installs primers into the cases. Gravity assists with securing cases in the disk assembly and promotes ejection of the finished cases. The compact construction of the machine makes the machine accessible for individuals or manufactures with limited space to create consistent ammunition at high speeds with limited space. Furthermore, the machine's design allows for any end user to assemble and maintain the machine with general hand tools, which obviates the need for specialized maintenance from the manufacturer.

15 Claims, 13 Drawing Sheets

TABLE TOP PRIMING MACHINE FOR SMALL CALIBER AMMUNITION

CROSS-REFERENCE TO RELATED APPLICATIONS

Figure 1:
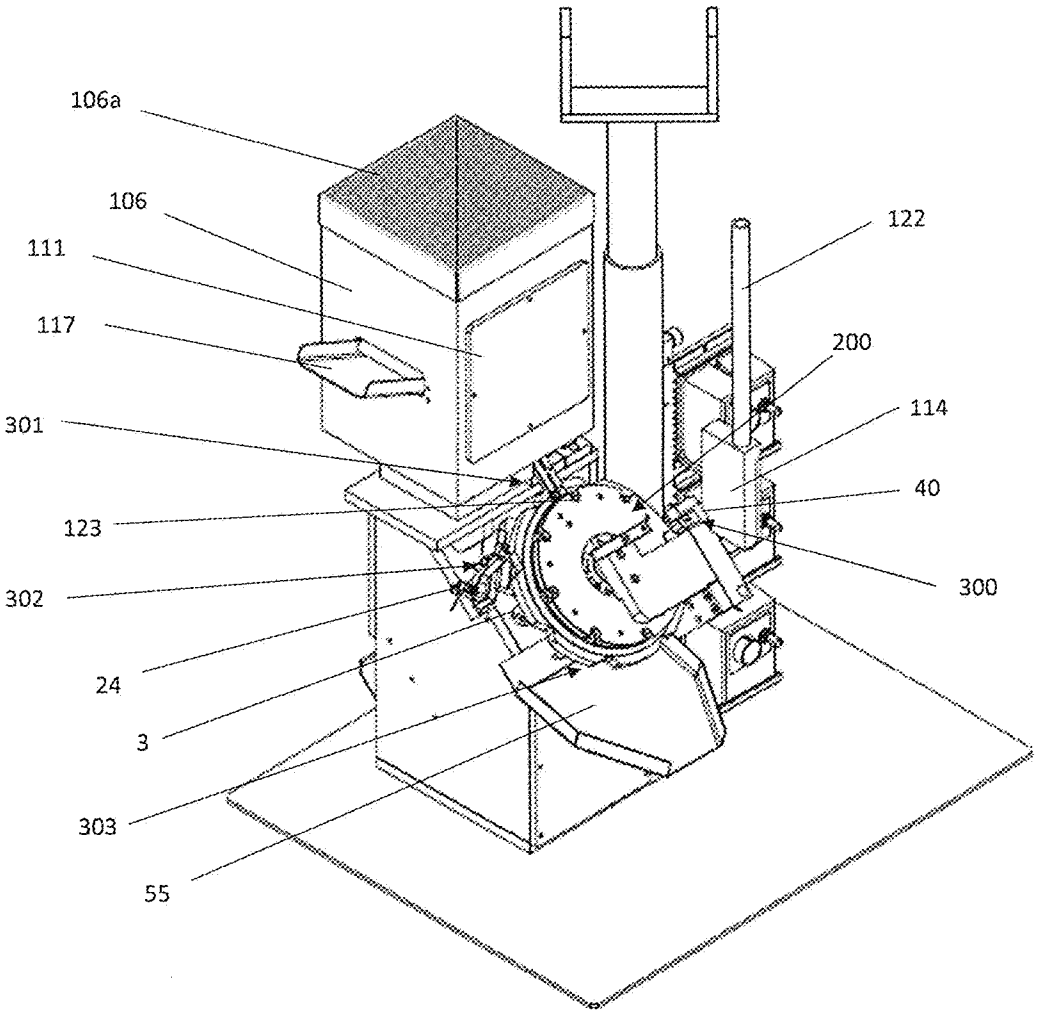

This is a U.S. Nonprovisional Applications, which claims priority from U.S. Provisional Application No. 62/961,287 filed Jan. 15, 2020, which claims priority from U.S. Non-Provisional application Ser. No. 17/149,328 filed Jan. 14, 2021, the disclosures of which are hereby incorporated by reference in their entirety to provide continuity of disclosure.

STATEMENT REGARDING FEDERALLY SPONSORED RESEARCH OR DEVELOPMENT

Not Applicable

THE NAMES OF THE PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

The herein described Table Top Priming Machine for Small Caliber Ammunition provides a simple, safe, and more precise means to produce reliable ammunition than other priming machines in the prior art. The Table Top Priming Machine uses a rotary disk assembly to hold cases as the machine installs primers into the cases. The compact construction of the machine makes the machine accessible for individuals or manufactures with limited space to create consistent ammunition at high speeds with limited space. Furthermore, the machine's design allows for any end user to assemble and maintain the machine with general hand tools, which obviates the need for specialized maintenance from the manufacturer.

BRIEF SUMMARY OF THE INVENTION

The herein described Table Top Priming Machine is comprised of a disk assembly, which rotates counterclockwise on a 45° axis angle with four primary stations acting upon it: 1) case feed, 2) primer insert, 3) primer staking and 4) eject. The cases are inserted at the 3:00 position, the primers are inserted at the 12:00 position, the staking is done at the 10:00 position and eject of the finished case is between the 8:00 and 6:00 position. The disk assembly axis is at an angle, which allows gravity to assist in keeping the cases installed in the disk between the 3:00 and 9:00 positions and promote ejection of the finished cases from the 8:00 and 6:00 positions. The machine is capable of priming 50 rounds per minute.

The case feed station provides the means to feed empty cases to be primed to the disk assembly. The case feed station is a mechanical cam feed with a return spring that uses grooves on the outside diameter of the rotating disk assembly for timing and actuation. This primer machine uses a standard case collator with a tube mounted on/off sensor to feed cases to the case feed mechanism. The cases enter the tube from the top and are moved sideways into the disk assembly with a cam operated arm and assist spring.

The primer insert station provides the means to feed primers to the disk assembly where primers will be inserted into the empty cases. The primer insert station is comprised of a vibratory bowl that feeds a guide down to a separate angled track at a 45° to match the disk angle. The guide has a heel at the bottom of the exit to the track to keep the primer orientation correct in the track. The track has a spring-loaded finger that helps insert one primer at a time into the disk assembly. The disk assembly has a nest on one of the plates to hold the primer prior to the staking station.

The primer staking station provides the means for insertion of primers into the empty cases. The primer staking station is comprised of a spring-loaded arm on an adjustable base that pushes up on a spring-loaded staking pin that is threaded into the lower disk assembly. The staking pin is the correct diameter to pass through the disk assembly and press the primer into the base of the cartridge case. As the pin passes the arm, it slides off the side and the arm return spring brings it to home to start the cycle again for the next pin. Height adjustment of the pin assembly determines final primer depth in the case.

The eject station uses a combination of gravity, a cam operated eject pin, and a secondary arm to remove the cases from the disk assembly. The cam driven pins are located in the upper disk and are guided by a cam that is bolted to the case feed arm assembly. The flat face of the case feed arm acts as a secondary eject source to remove any cases that are not fully ejected. Cases that are ejected are guided by a chute mounted in the middle of the machine.

The machine is powered by a 90° gear motor to reduce overall height. The motor drives a clutch/spindle assembly that mounts the disk assembly on the upper part of the machine.

The disk assembly is comprised of nine parts: 1) top disk, 2) extractor disk, 3) flange disk, 4) case disk, 5) nest disk, 6) pin disk, 7) threaded pin disk, 8) staking pin assembly, and 9) eject pin.

The top disk includes the eject pins, springs and clips used on the eject station. It also supports the slotted sides of the case groove disk during primer staking.

The extractor disk uses spring loaded slots to hold the case in position for primer insert and staking. Thickness of the disk is dependent of the caliber of the case and the case eject groove dimensions.

The flange disk is a spacer for the bottom of the case flange. Thickness of the disk is dependent of the caliber of the case and the eject groove dimensions.

The case disk is further comprised of a hole that guides the primer up from the nest disk into the bottom of the case when staked by the staking pin assembly.

The nest disk has a groove on the outside diameter, which provides a space for one primer at a time to be inserted in the proper location.

The pin disk supports the end of the staking pin assembly and guides the pin through the disk assembly. The top of the staking pin is below flush of the guide pin disk to provide a "seat" for the inserted primer which helps center the primer through the hole in the primer guide disk. The holes in the guide pin disk and primer guide disk match the size of the primers being used.

The threaded pin disk holds the staking pin assemblies and has grooves on the outside diameter that actuate the case feed arm assembly. The threaded pin disk is the attachment for the spindle assembly and is locked in place with a key.

The staking pin assembly is comprised of a threaded housing that holds a spring-loaded pin. The top of the pin matches the size of the primers being used.

The eject pin is spring loaded and removes the cases at the bottom of rotation. The pin is fully retracted when cases are present and rotates on a cam that extends the pin at the bottom of the cycle to remove the cases.

There are three mounted electrical switches that actuate the collator, vibratory bowl and motor drive. The switches all are on/off with variable speed controls. The intent of the machine is to be small enough to be mounted on a table-top or toolbox. The machine is simple enough that the end user can assemble and maintain it with simple hand tools.

BRIEF DESCRIPTION WITH SEVERAL VIEWS OF DRAWINGS

FIG. 1. Is an elevated left side perspective view of the Table Top Priming Machine.

Figure 2:
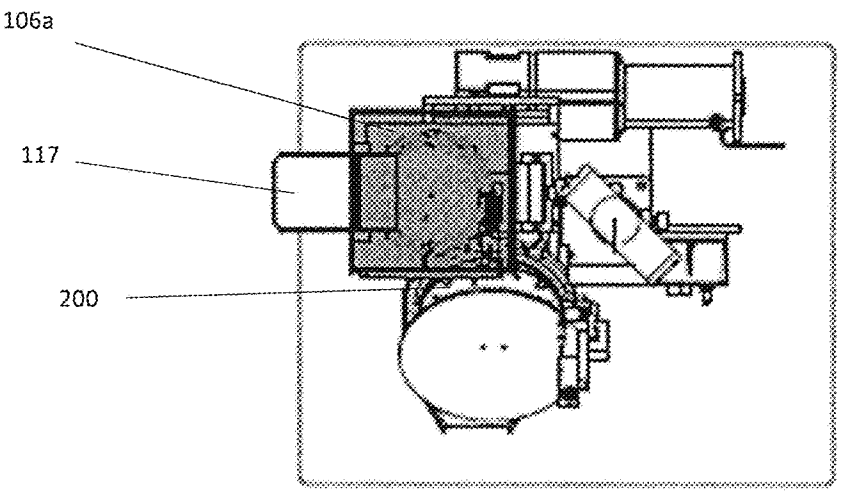

FIG. 2. Is an overhead view of the Table Top Priming Machine.

Figure 3A:
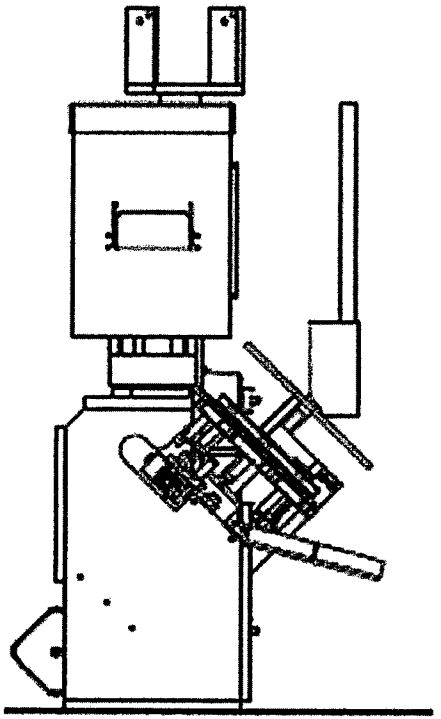

FIG. 3A. Is left side lateral view of the Table Top Priming Machine.

Figure 3B:
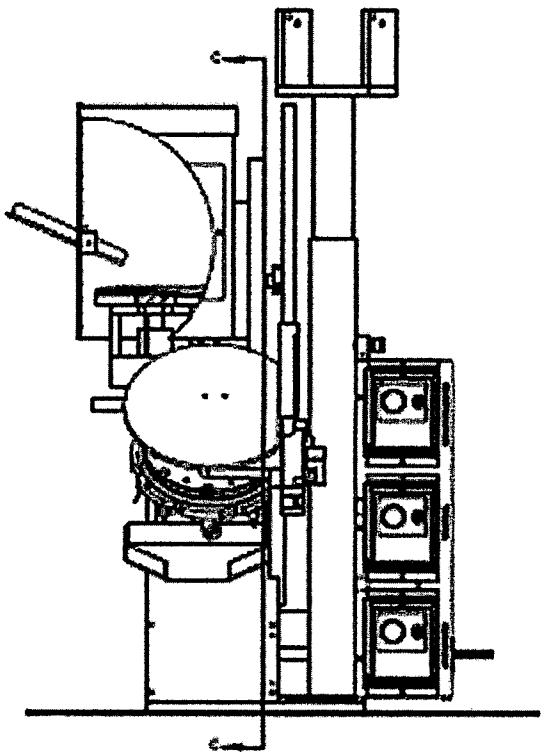

FIG. 3B. Is a front view of the Table Top Priming Machine.

Figure 3C:
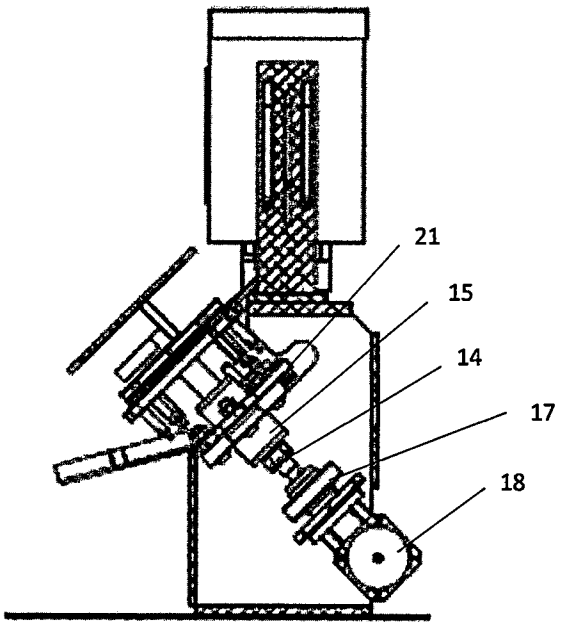

FIG. 3C. Is a right side lateral view of the Table Top Priming Machine.

Figure 4:
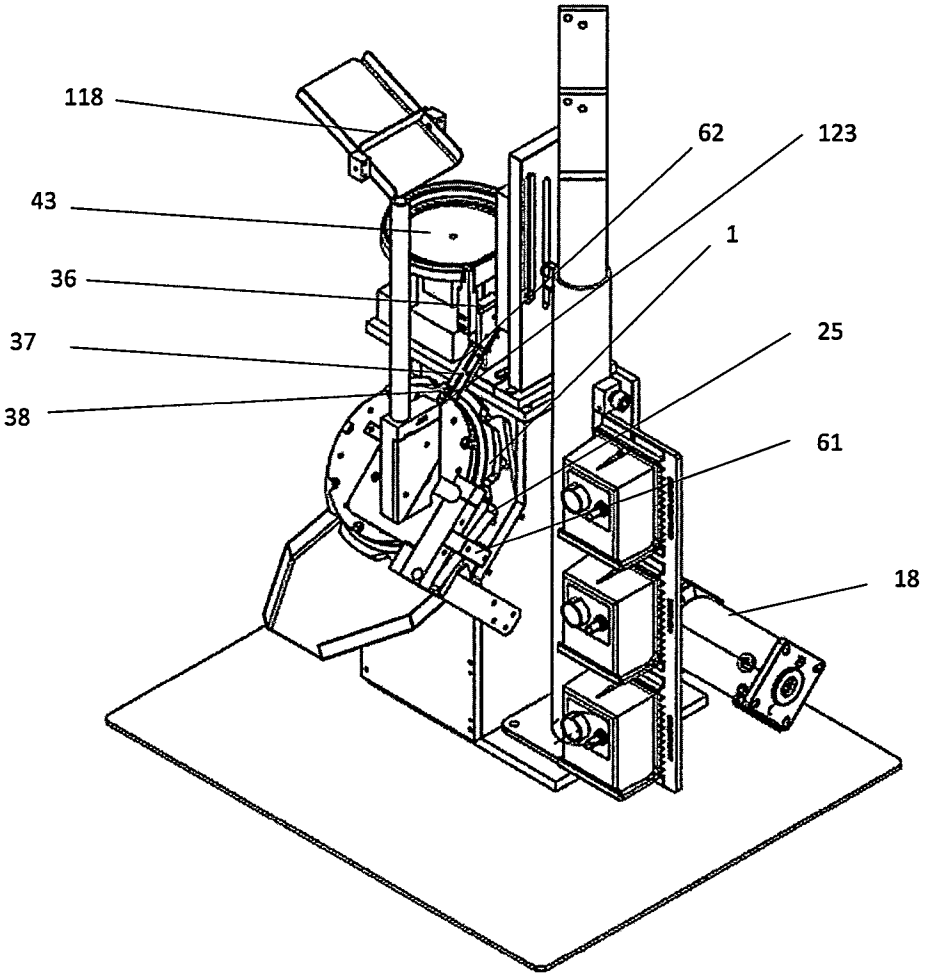

FIG. 4. Is an elevated right side perspective view of the Table Top Priming Machine with guard removed.

Figure 5:
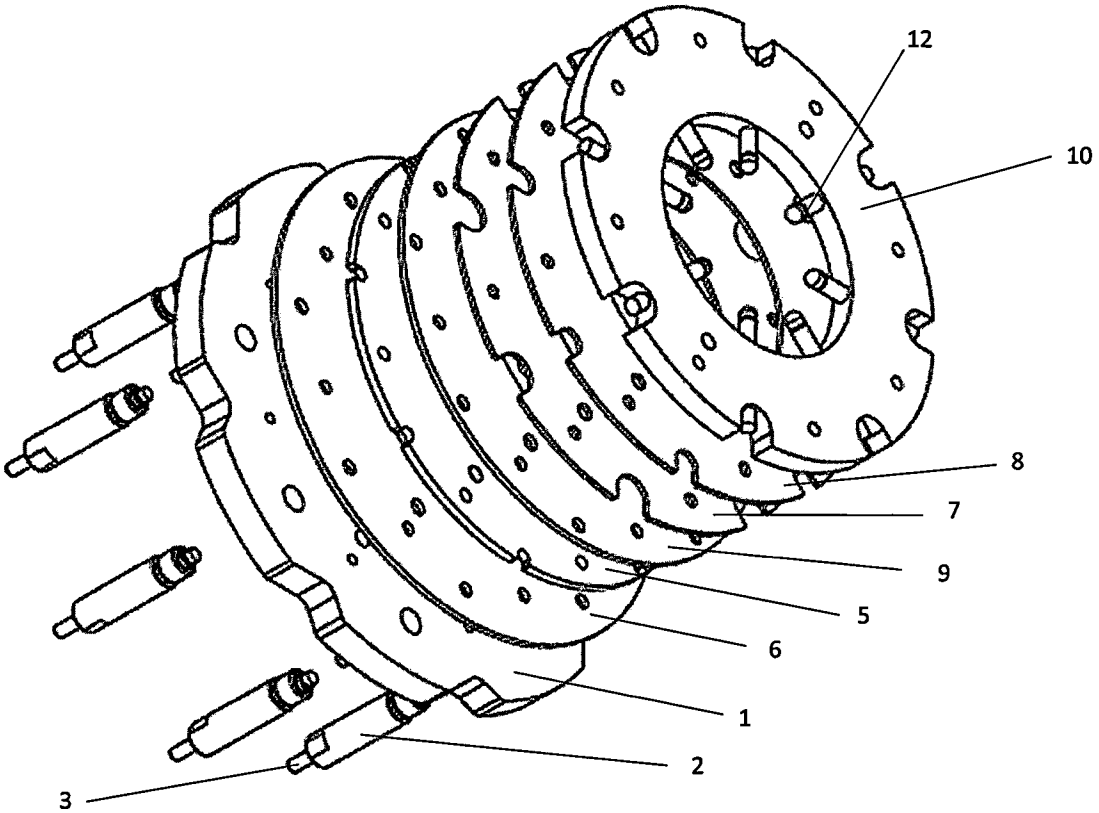

FIG. 5. Is a perspective view of the disk assembly disassembled of the Table Top Priming Machine.

Figure 6:
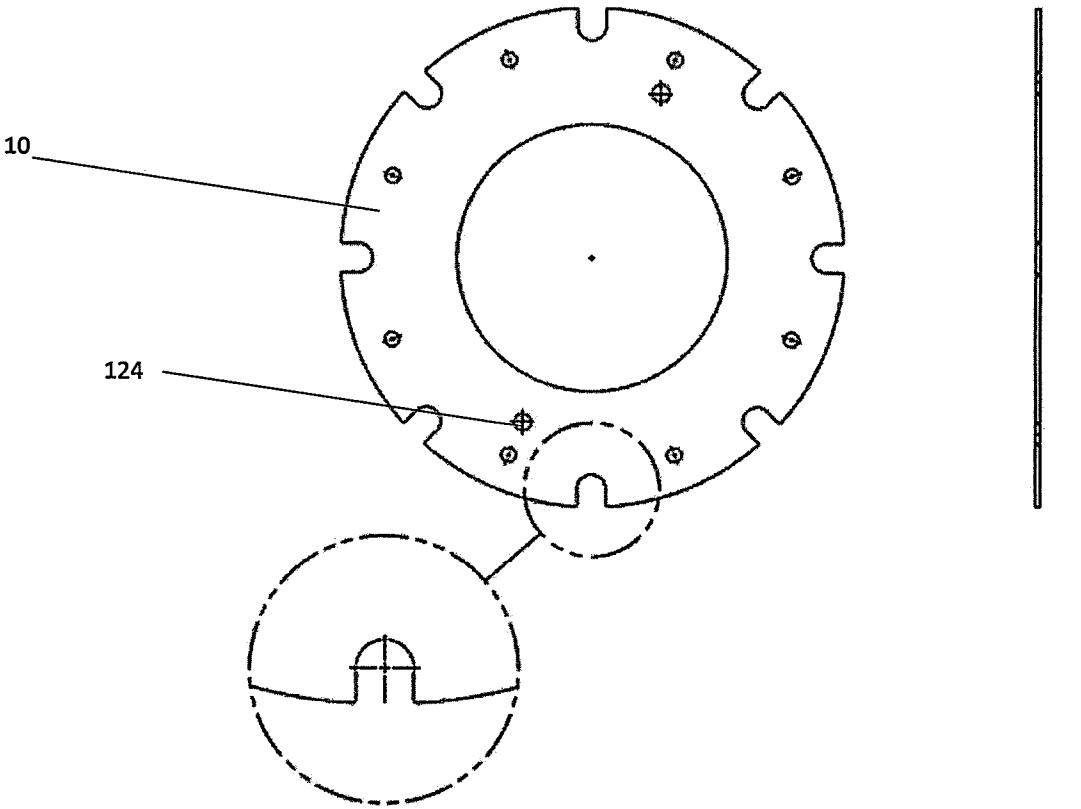

FIG. 6. Is an overhead elevated view of the top disk of the disk assembly.

Figure 7:
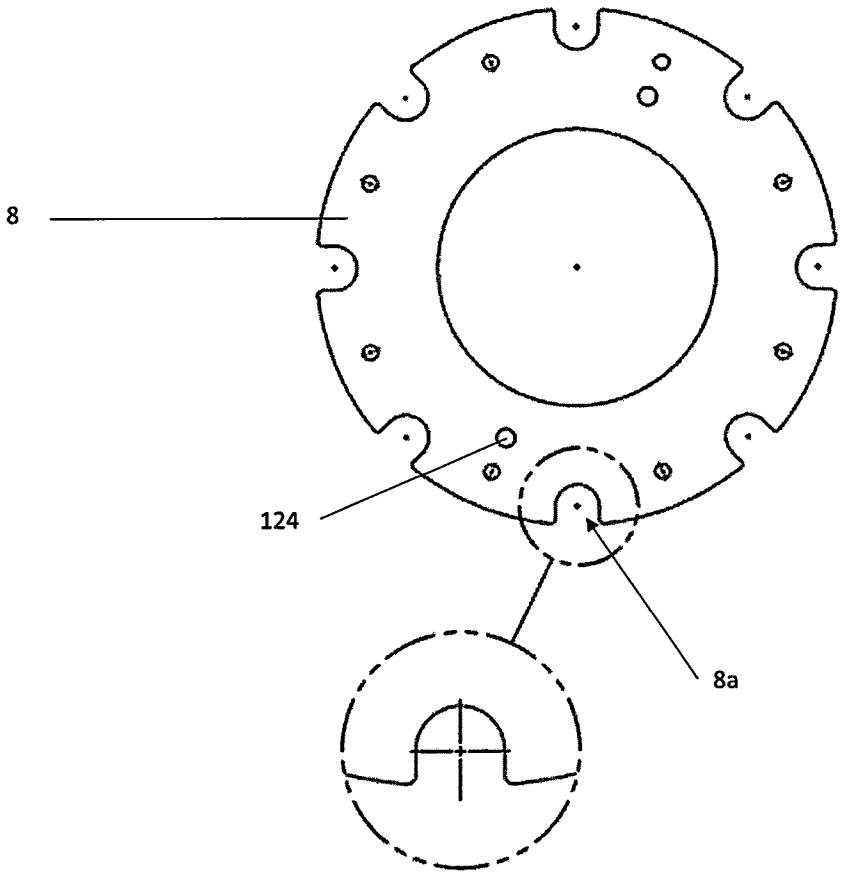

FIG. 7. Is an overhead elevated view of the extractor disk of the disk assembly.

Figure 8:
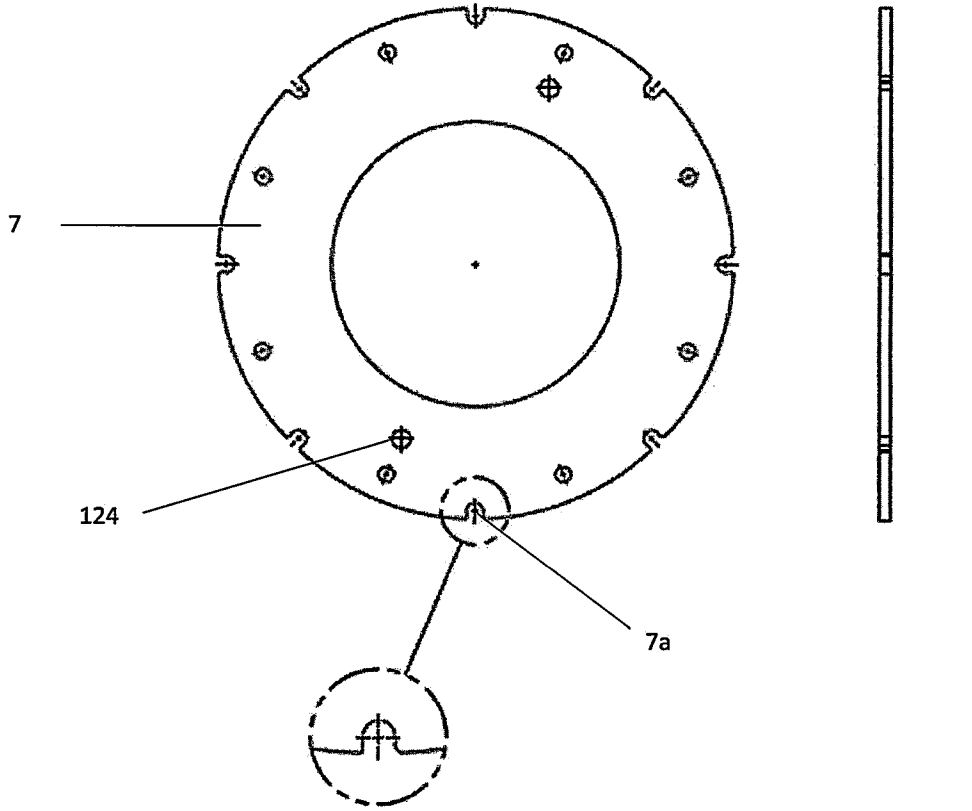

FIG. 8. Is an overhead elevated view of the flange disk of the disk assembly.

Figure 9:
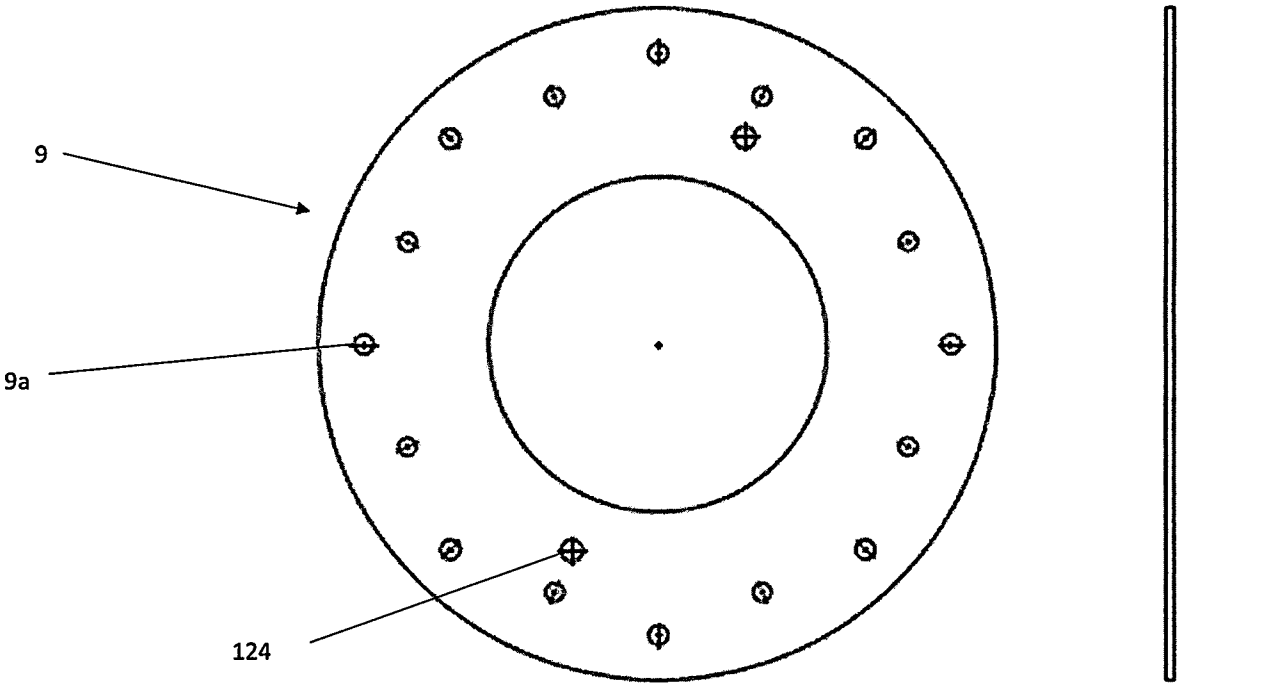

FIG. 9. Is an overhead elevated view of the case disk of the disk assembly.

Figure 10:
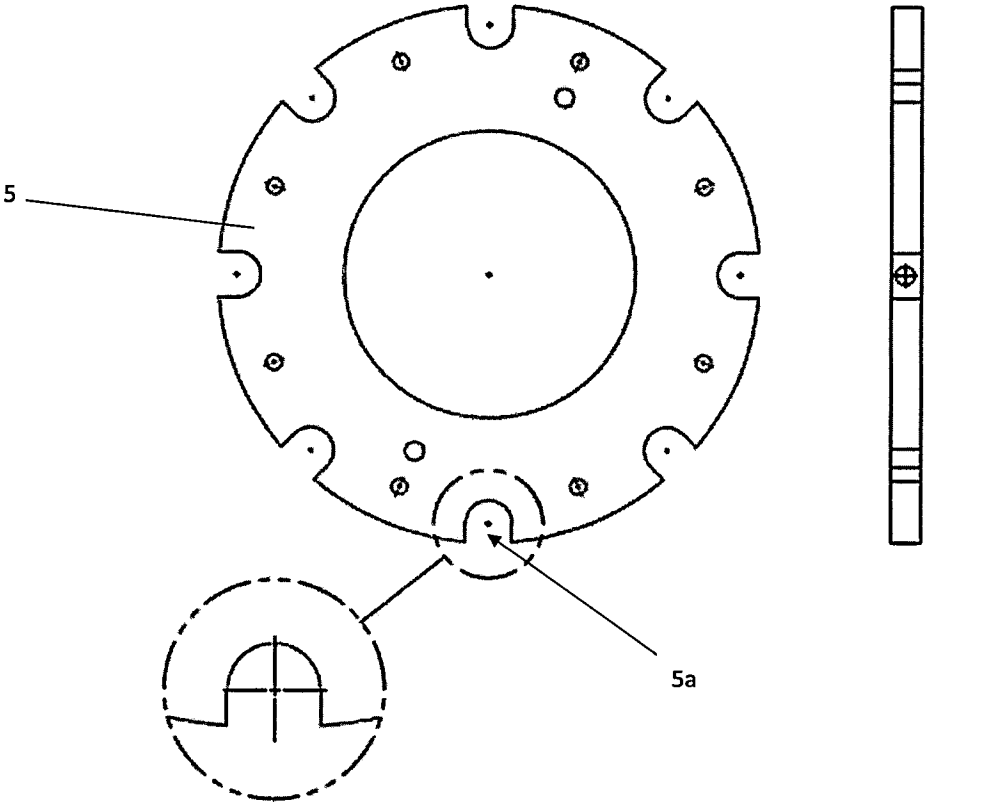

FIG. 10. Is an overhead elevated view of the nest disk of the disk assembly.

Figure 11:
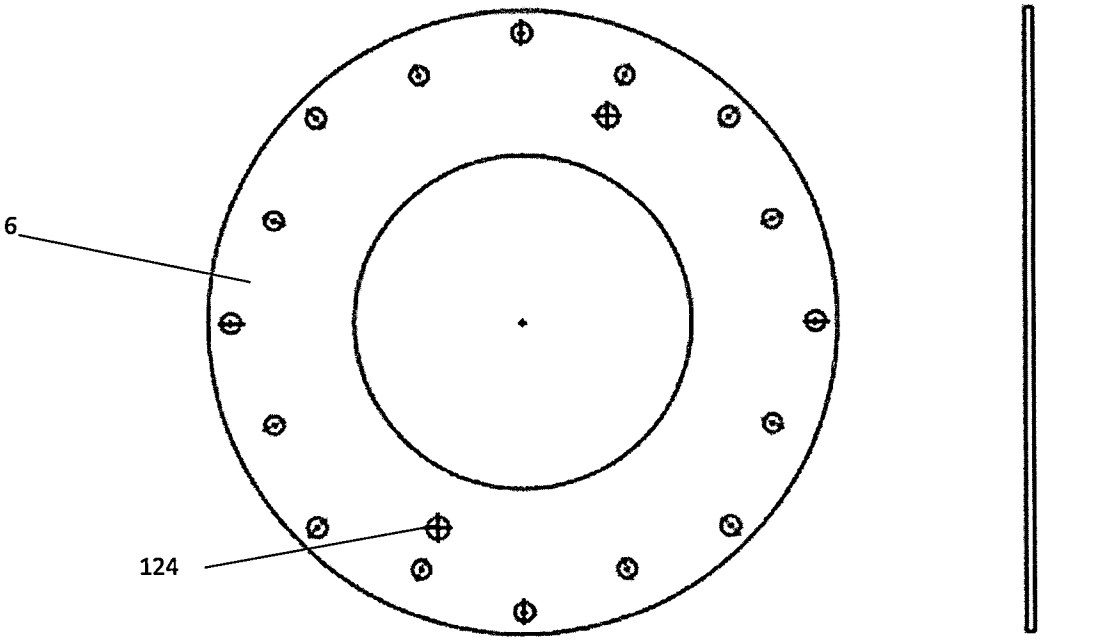

FIG. 11. Is an overhead elevated view of the pin disk of the disk assembly.

Figure 12C:
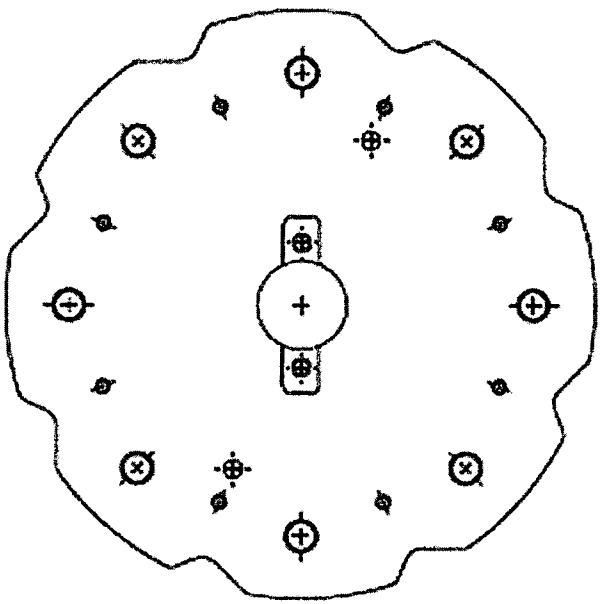
Figure 12B:
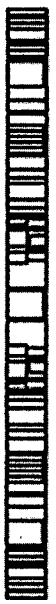
Figure 12A:
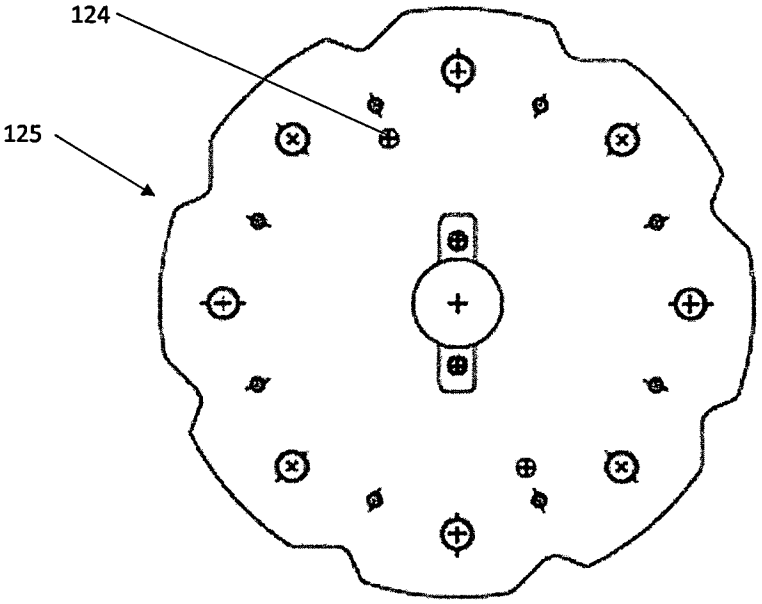

FIG. 12A. Is an overhead elevated view of the threaded pin disk of the disk assembly.

FIG. 12B. Is a side view of the threaded pin disk of the disk assembly.

FIG. 12C. Is a bottom view of the threaded pin disk of the disk assembly.

Figures 13A, 13B, 13C:
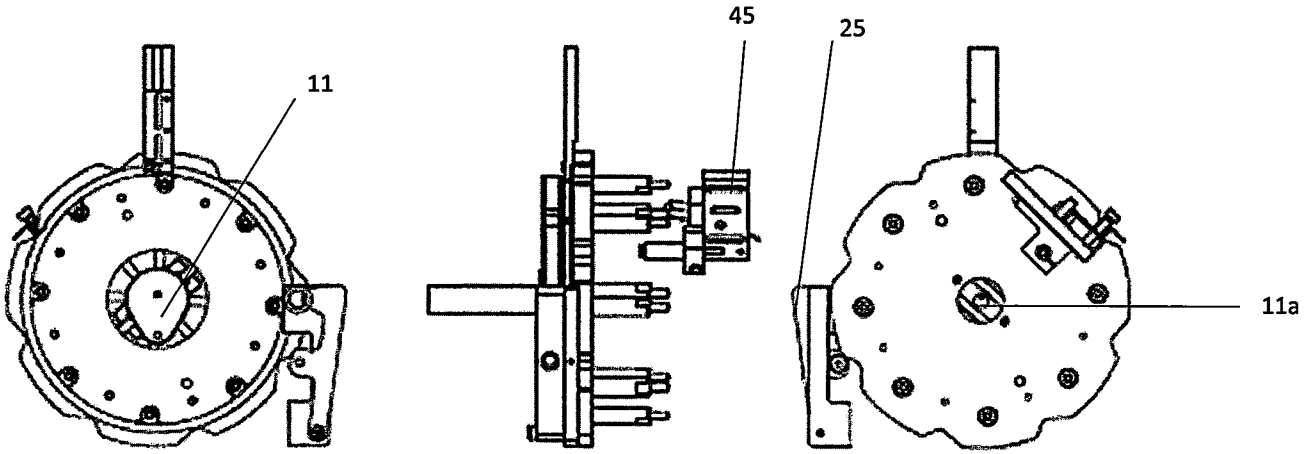

FIG. 13A. Is an overhead elevated view of the case loading station of the Table Top Priming Machine.

FIG. 13B. Is a lateral view of the case loading station of the Table Top Priming Machine.

FIG. 13C. Is a bottom view of the case loading station of the Table Top Priming Machine.

DETAILED DESCRIPTION OF THE INVENTION

With reference to the accompanying drawings, the Table Top Priming Machine is further described in detail. The disk assembly 200 rotates counterclockwise on a 45° axis angle with four primary stations acting on it: 1) case feed station 300, 2) primer insert station 301, 3) primer staking station 302 and 4) eject station 303. The cases are inserted at the 3:00 position, the primers are inserted at the 12:00 position, the staking is done at the 10:00 position and eject of the finished case is between the 8:00 and 6:00 position. The disk axis is at an angle to have gravity assist in keeping the cases installed in the disk between the 3:00 and 9:00 positions and promote ejection of the finished cases from the 8:00 and 6:00 positions.

At the case feed station 300, empty cases are delivered to a feed tube 122 from the collator that sorts the brass cases with a base down configuration for priming. The cases are then oriented into a 45° angle while going through the case rotator 114. The case rotator 114 is comprised of a clear plexiglass cover to monitor the cases. The case rotator 114 delivers the cases, base end down into a lower-case tube 40. The case tube is caliber specific and is slotted on one side to allow the case to be inserted into the priming rotary disk assembly 200. A case feed arm 25 has a compression return spring and is cam driven. The case feed arm pushes the base of the case into the disk assembly 200. A compression spring is retained by a spring plate 61. Compression springs are used due to their longevity.

The cam consists of recesses on the outside of the threaded pin disk 1 and are in constant contact with the cam follower attached to the bottom of the case feed arm 25 The cases then rotate in a counterclockwise direction in the disk to the primer feed station 300. Disks of the assembly are rotated at a constant speed by a motor 18. The motor 18 is coupled to a spindle 14 by a clutch 17. The spindle rotates in a hub 15 that is mounted to a spindle plate 21. The spindle 14 is then mounted directly to the disk assembly 200 with a key.

Primers are oriented with a vibratory primer bowl 43 mounted to the top of the machine. The feed bowl assembly is surrounded with an adjustable height guard 106 in case of primer detonation. The guard 106 has a clear, polycarbonate window 111 to view the primer quantity in the vibratory primer bowl 43 safely. There is a wire mesh screen top 106*a* that covers the guard 106 to keep debris out and keep any explosive forces going up in a vertical direction away from an operator in the case of primer detonation. Mounted to the side of the height guard is a chute 117 to allow filling of the primer bowl 43 without lifting the guard 106. Above the chute is a deflector 118 that would keep any potential shrapnel contained within the guard 106 in the event of a detonation.

At the primer insert station 301, the primers exit the vibratory bowl 43 through a tube to the track feed 36 where the primers are rotated 45 degrees and fed into the primer track 37. The track 37 is comprised of a cover 62 to keep the primers in place and moving down the track 37. At the end of the track 37 is a swing arm 38 that inserts the primers, one at a time into a recess 123 of the disk assembly 200. The case and primer are then moved to the primer staking station 302 to have the primers inserted to the proper depth. As the disk assembly 200 passes over the stake finger 24, the stake finger 24 engages the staking pin 3 and the staking pin 3 pushes the primer up through the disks and into the case held above. The staking pin 3 is spring loaded and retained with a stake pin holder 2. A finger is spring-loaded and mounted to an adjustable stake plate 45. The stake plate 45 can be moved up and down to adjust the depth of the primer.

As the primed cases pass a lobe of the cam 11 mounted in the center of the disk assembly 200, eject pins 12 in the top disk 10 push against the cases and they are ejected at the eject station 303. The primed cases are then dropped onto the chute 55 to exit the machine.

The disk assembly 200 is comprised of seven separate disks, each performing a different role and are further described from bottom to top. A threaded pin disk 1 (FIGS.

12A-C) is comprised of connection means to connect the disk assembly 200 to the spindle 14. The spindle 14 is mounted directly to the disk assembly 200 with a key. The threaded pin disk also locates the other disks with a pair of dowels running through all of the disks. The threaded pin disk 1 has threaded holes 124 to accommodate the dowels and sandwich the other disks between it and the top disk 10 when bolted together. The threaded pin disk 1 is also comprised of cam features 125 on the perimeter for actuating the cam follower on the case feed arm 25. The staking pin holder 2 is threaded into threaded pin disk 1.

A pin disk 6 (FIG. 11) is mounted directly above the threaded pin disk 1. The pin disk 6 guides the top of the staking pin 3 into the other disks to push the primers into the cases.

A nest disk 5 (FIG. 10) is mounted directly above the pin disk 1. The nest disk 5 is comprised of a plurality of pockets 5*a* of the perimeter of the nest disk 5, which primers enter as they pass the primer track 37. The pockets 5*a* retain the primers until they move to the staking station 300.

A case disk 9 (FIG. 9) is mounted directly above the nest disk 5. The case disk 9 provides a stop for the bottom of the case. It also has primer locating holes 9*a* to center the primers in the cases above as they are been pushed up into the cases.

A flange disk 7 (FIG. 8) is mounted directly above the case disk 9. The flange disk 7 has a plurality of flange disk pockets 7*a* on the perimeter to loosely locate the base of the cases as they are being inserted into the disk assembly 200. The flange disk 7 also serves as a spacer between the extractor disk 8 and the case disk 9.

An extractor disk 8 (FIG. 7) is mounted directly above the flange disk 7. The extractor disk 8 is comprised of a plurality of extractor groove pockets 8*a* of the perimeter of the extractor disk 8, which hold the case snugly at the extractor groove of each case. By holding each case at the extractor groove, cases are properly centered over the other disks of the disk assembly 200 to insert the primers.

A top disk 10 (FIG. 6) is mounted on the top of the stack of disks and when bolted through to the threaded pin disk 1, it creates the complete disk assembly 200. The top disk 1 is comprised of eight (8) spring loaded eject pins 12, which are retained with snap rings. The pins ride on the outside of a cam 11 that is mounted to a fixed stand 11*a* in the center of the disk assembly 200. As the eject pins 12 pass over the tallest part of the cam 11, the eject pins 12 are pushed outward, which ejects the cases onto the chute 55 to exit the machine.

It is understood that the foregoing examples are merely illustrative of the present invention. Certain modifications of the articles and/or methods may be made and still achieve the objectives of the invention. Such modifications are contemplated as within the scope of the claimed invention.

What is claimed is:

1. A Table Top Priming Machine comprising:

a. a case feed station, which feeds a plurality of cases to a rotatory disk assembly, where said rotatory disk assembly is mounted at a 45 degree angle relative to gravity to allow gravity to assist in keeping said plurality of cases installed in said disk assembly between a 3:00 and a 9:00 position and promote ejection of primed cases between an 8:00 and a 6:00 position;

b. a primer insert station, which feeds a plurality of primers to said rotatory disk assembly;

c. a primer staking station, wherein said plurality of primers are inserted into said cases to create a primed case;

d. an eject station, wherein said primed cases are ejected; and e. a motor, which rotates said rotary disk assembly, wherein said case feed station, primer feed station, primer staking station, and eject station act upon said plurality of cases and plurality of primers, which have been fed to said rotary disk assembly.

2. The Table Top Priming Machine of claim 1 where said rotary disk assembly is comprised of a top disk, extractor disk, flange disk, case disk, nest disk, pin disk, and threaded pin disk.

3. The Table Top Priming Machine of claim 2 where said top disk, extractor disk, flange disk, case disk, nest disk, pin disk, and threaded pin disk are all comprised of at least one threaded hole to accommodate at least one dowel through said at least one threaded hole to sandwich said disks together when bolted.

4. The Table Top Priming Machine of claim 1 where said rotary disk assembly is further comprised of at least one eject pin.

5. The Table Top Priming Machine of claim 1 where said rotary disk assembly is further comprised of a plurality of extractor groove pockets on the perimeter of an extractor disk.

6. The Table Top Priming Machine of claim 1 where said rotary disk assembly is further comprised of a plurality of flange disk pockets on the perimeter of a flange disk.

7. The Table Top Priming Machine of claim 1 where said rotary disk assembly is further comprised of a case disk comprised of a plurality of primer locating holes to center said primers in said cases.

8. The Table Top Priming Machine of claim 1 where said rotary disk assembly is further comprised of a nest disk comprised of a plurality of nest disk pockets on the perimeter of said nest disk, which retain said primers until said primers move to said primer staking station.

9. The Table Top Priming Machine of claim 1 where a pin disk guides a staking pin into other disks of said rotary disk assembly to push said primers into said cases.

10. The Table Top Priming Machine of claim 1 where said rotary disk assembly is further comprised of a threaded pin disk comprised of a plurality of cam features on the perimeter of said threaded pin disk, which actuate a cam follower of a case feed arm.

11. The Table Top Priming Machine of claim 10 where said threaded pin disk is connected to a spindle, which is connected to said motor.

12. The Table Top Priming Machine of claim 11 where said motor is coupled to a said spindle by a clutch wherein said spindle rotates in a hub mounted to a spindle plate and said spindle is connected to said disk assembly with a key.

13. The Table Top Priming Machine of claim 1 where said case feed station is further comprised of a collator, a case rotator, and caliber specific case tube.

14. The Table Top Priming Machine of claim 1 where said primer insert station is comprised of a vibratory bowl, tube, track feed, and swing arm.

15. The Table Top Priming Machine of claim 1 where said primer staking station is comprised of a stake finger, a spring loaded staking pin, and an adjustable stake plate.

* * * * *